United States Patent [19]

Bolli et al.

[11] Patent Number: 4,666,079

[45] Date of Patent: May 19, 1987

[54] PACKING FOR FLAT, RECTANGULAR PRODUCTS AND METHOD

[75] Inventors: Hans-Ulrich Bolli, Schleitheim, Switzerland; Franz-Josef Widmann, Hilzingen, Fed. Rep. of Germany

[73] Assignee: Sig Schweizerische Industrie-Gesellschaft, Neuhausen am Rheinfall, Switzerland

[21] Appl. No.: 838,331

[22] Filed: Mar. 10, 1986

[30] Foreign Application Priority Data

Mar. 11, 1985 [CH] Switzerland ..... 1091/85

[51] Int. Cl.[4] ..... B65D 85/10; B65D 65/00

[52] U.S. Cl. ..... 229/87 F; 206/273

[58] Field of Search ..... 229/87 F, 87 R, 87 G, 229/87 B, 87 J; 206/273, 424, 605, 606, 608, 491

[56] References Cited

U.S. PATENT DOCUMENTS

| | | | |
|---|---|---|---|
| 1,869,584 | 8/1932 | Reymond | 229/87 F |
| 1,947,618 | 2/1934 | Sawin | 229/87 F |
| 2,279,842 | 4/1942 | Smith et al. | 229/87 R |
| 2,596,620 | 5/1952 | Townsend | 229/87 F |
| 2,671,731 | 3/1954 | Vogt | 229/87 F |
| 3,124,298 | 3/1964 | Repko | 229/87 R |
| 3,489,333 | 1/1970 | Culberg et al. | 229/87 R |
| 4,003,467 | 1/1977 | Focke et al. | 206/273 |
| 4,505,385 | 3/1985 | Focke et al. | 206/273 |

FOREIGN PATENT DOCUMENTS

| | | | |
|---|---|---|---|
| 87638 | 7/1921 | Fed. Rep. of Germany | 229/87 F |
| 1030247 | 5/1958 | Fed. Rep. of Germany . | |
| 3214240 | 10/1983 | Fed. Rep. of Germany . | |
| 952198 | 11/1949 | France | 229/87 F |

*Primary Examiner*—Willis Little

*Attorney, Agent, or Firm*—Spencer & Frank

[57] ABSTRACT

A packing for a flat, rectangular product includes a wrapper sheet surrounding the product at its large faces to form a sleeve which has face-to-face arranged end portions sealed together adjacent a longitudinal packing edge to form a fin seal. The end portions form, beyond the fin seal, an inner and an outer longitudinal panel. The wrapper sheet further has two opposite end closure flaps folded, from opposite longitudinal ends of the product, onto the sleeve on one of the large faces of the product, and the panels are folded onto the sleeve on the large face. The outer panel projects beyond the inner panel and covers the end closure flaps. A securing arrangement attaches the outer panel to the sleeve on the large face of the product.

9 Claims, 6 Drawing Figures

PACKING FOR FLAT, RECTANGULAR PRODUCTS AND METHOD

BACKGROUND OF THE INVENTION

This invention relates to a packing for a flat, reactangular product, such as a chocolate bar. The packing comprises a wrapper sheet which, on its inner side, that is, on its side oriented towards the product is provided with a closing or sealing layer and is folded about the product as a longitudinal fin seal and two end closure flaps are formed. The longitudinal fin seal is situated adjacent a first longitudinal edge of the packing and the two oppositely located end closure flaps as well as the flaps which form the longitudinal fin seal are folded onto one of the large faces of the packing.

The above-outlined known packing comprises an aluminum foil which has at its inside a thermoplastic sealing layer. The longitudinal fin seal provides for a hermetic closure and also serves as a warranty seal. The two panels which form the longitudinal fin seal are of equal width and are folded flat onto the underside of the packing. The two oppositely located end closure flaps are also folded onto the underside, over the two longitudinal panels. This arrangement necessarily interrupts one of the two large packing faces which could carry a commercial message thereon. For this purpose it is customary to complement the packing with a second, external paper wrapper. This is disadvantageous in that it requires additional packaging material and additional technological input in the wrapping machines.

German Auslegeschrift (Examined Published Application) No. 1,030,247 discloses an outer paper wrapper for a packing of the above-outlined type wherein first the opposite end closure flaps are folded onto the underside of the chocolate bar and the remaining two longitudinal panels are then folded thereonto. Such an overlapping wrapper-type is not adapted to form sealing seams because they have to be fin seals. A hermetic sealing of the product is therefore not possible.

U.S. Pat. No. 3,124,298 discloses a packing which has a longitudinal fin seal, although the packing is not used in connection with flat rectangular products. The fin seal stands up perpendicularly from one of the wrapper surfaces and thus interrupts the surface which could be, as a whole, advantageously used for a commercial message.

German Offenlegungsschrift (Non-examined Published Application) No. 3,214,240 discloses a bag for cut tobacco wherein the two panels forming two longitudinal fin seals are of unequal length. For making the bag, first a rectangular, multi-layer synthetic film is folded longitudinally and sealed along the two opposite lateral edges. Subsequent to filling the bag with the product, the bag is closed by a sealing strip extending along the entire length of the panels. The panels are folded-in laterally and, by bending them, they eventually are placed onto one of the flat sides of the bag. Such a packaging is not adapted for flat rectangular products because the two end closures have to be provided prior to placing the product into the bag and the sheet material in the zone of its bend may not be flattened by folding. As a result, the end faces of the packing do not have an eye-pleasing appearance.

SUMMARY OF THE INVENTION

It is an object of the invention to provide an inproved packing of the above-outlined type which has, on both sides, a large, uninterrupted surface adapted to carry a commercial message and which ensures that the contents are hermetically sealed and are tamper-proof.

This object and others to become apparent as the specification progresses, are accomplished by the invention, according to which, briefly stated, one of the two wrapper panels forming the longitudinal fin seal projects beyond the edge of the other panel, covers the end closure flaps previously folded on a large face of the article and is secured to that large face with securing means.

DESCRIPTION OF THE PREFERRED EMBODIMENT

Figure 1:
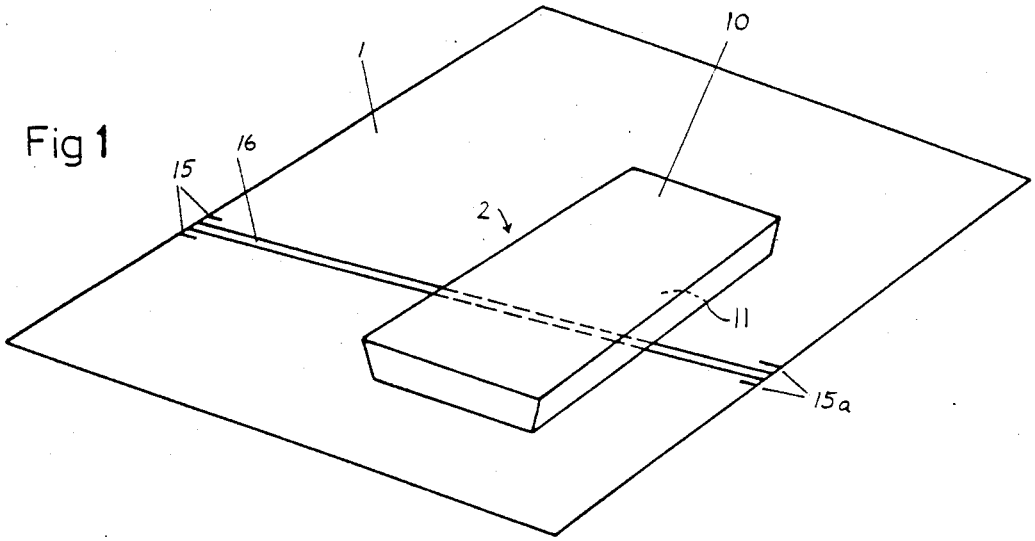
FIGS. 1, 2, 3 and 4 are perspective illustrations of four successive stages in the preparation of a packing according to the invention.
Figure 2:
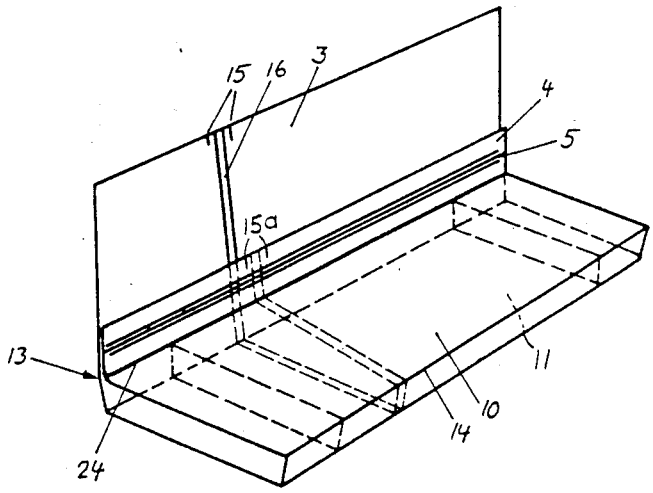

The packing, shown in various packaging phases in the Figures, packages a chocolate bar 2 and is formed of a rectangularly cut aluminum foil 1 provided on the inside with a sealing layer. In the first packaging step, illustrated in FIG. 1, the chocolate bar 2 is placed on the foil. The bottom face 10 of the bar 2 is oriented upwardly, while its top face 11 is oriented downwardly. In the second packaging step, as shown in FIG. 2, the foil 1 is wrapped around the chocolate bar 2 to form a sleeve and the two meeting, face-to-face arranged end portions of the foil are folded upward along a longitudinal edge 13 to thus obtain an outer, longer panel 3 and an inner, shorter panel 4. As seen in FIG. 2, the outer panel 3 projects significantly beyond the inner panel 4. The latter has a folded edge 24. The panels 3 and 4, at the overlapping portions thereof, are provided with a longitudinal sealing seam 5 whereby a fin seal is obtained.

Figure 3:
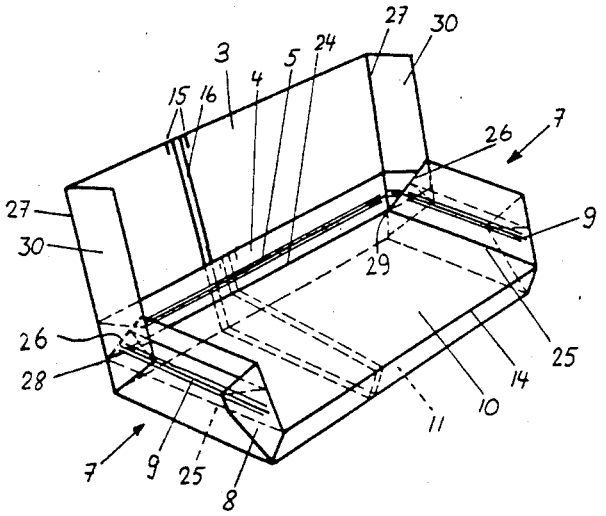

In the third packaging step, as illustrated in FIG. 3, the end closure flaps 7 are formed and folded upwardly. This is effected in several steps: the foil portion extending coplanar with the bottom face 10 and projecting at both ends therebeyond is turned upwardly along opposite folding edges 25, the foil portion extending coplanar with the top face 11 and projecting at both ends therebeyond is folded upwardly along end faces of the bar 2, edges 8 of the end closure flaps 7 are folded inwardly, and at the ends of the panels 3 and 4 marginal portions are folded downwardly to form folds 27 and respective flaps 30. During this folding operation, at the end closure flaps 7 there is obtained a terminal folding edge 26 extending from the corners 28 and 29. It is seen that the edges 24, 25 and 27 also extend from respective corners 28, 29. The panel 3 projects upwardly at an oblique angle to the chocolate bar bottom 10. In this position the two end closure flaps 7 are sealed by respective sealing seams 9.

Figure 4:
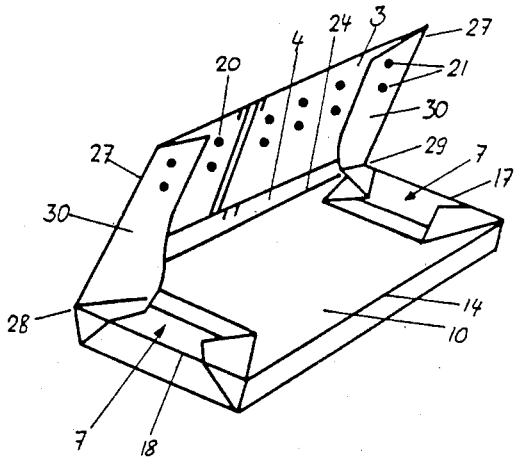

In the subsequent packaging step, as shown in FIG. 4, the two end closure flaps 7 are folded flat against the chocolate bar bottom 10, whereby folds 17 and 18 are formed, the panel 3 is provided with hot melt or cold glue spots 20, 21 and is then pressed flat against the packing portion previously folded onto the bottom face 10. Upon this occurrence the end closure flaps 7 are covered by the panel 3. The adhesive spots 21 bond the flaps 30 of the panel 3 to the end closure flaps 7.

Figure 5:
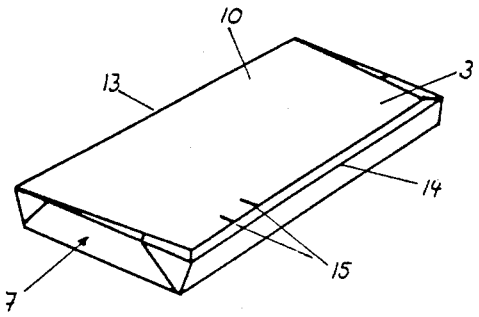
FIG. 5 is a perspective view of the completed packing according to the preferred embodiment.

FIG. 5 illustrates the completed packing. By virtue of the fact that at the bottom face 10 the panel 3 reaches almost to the opposite longitudinal edge 14 of the packing, and its length is only slightly less than the length of the chocolate bar, the packing has both on the top face 11 and the bottom face 10 a large, uninterrupted, smooth surface adapted to carry a commercial message. The sealing seams 5 and 9 hermetically and securely close the package. By virtue of this packaging arrangement, the stringent requirements for packings are satisfied by a single foil without the need of a surrounding second wrapper. This not only simplifies the packing itself, but also, the packaging machine need not be designed to handle a second, outside wrapper.

Figure 6:
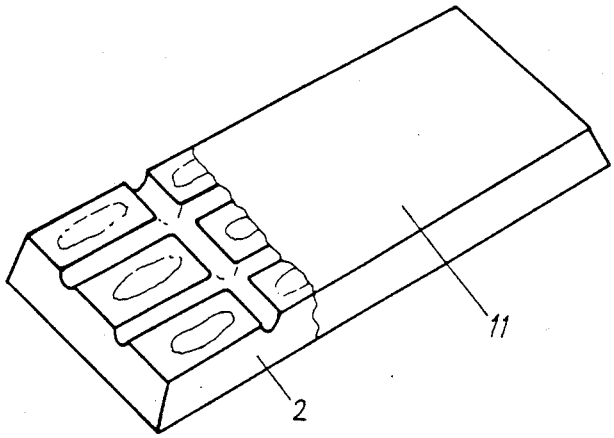
FIG. 6 is a perspective view of the torn-open packing, with the product partially exposed.

Turning once again to FIGS. 1–3, for opening the packing there is provided a tear-open strip 16 which extends transversely to the longitudinal edges 12, 13 and 14 over the entire width of the foil 1. Adjacent the tear-open strip 16 the edges of the panels 3 and 4 each have cuts 15 and 15*a*. The tear-open strip 16 intersects the edges 13 and 14 at an angle which is slightly less than 90°. As may be observed in FIG. 3, in this manner the portions of the tear-open strip 16 do not overlie one another in the panels 3 and 4. This, on the one hand, ensures a hermetic seal and, on the other hand, ensures a problem-free opening of the packing. FIG. 6 illustrates the packing which was opened by pulling the tear-open strip 16 all around the packing. By removing the shorter, separated part of the packing, one portion of the chocolate bar 2 is exposed which can be broken off by the consumer. The portion of the packing remaining on the chocolate bar affords a good protection for the item and the consumer's fingers against mutual soiling.

It will be understood that the above description of the present invention is susceptible to various modifications, changes and adaptations, and the same are intended to be comprehended within the meaning and range of equivalents of the appended claims.

What is claimed is:

1. In a packing for a flat, rectangular product having opposite large faces each having a length and a width, including a wrapper sheet surrounding the product at the large faces to form a sleeve and having face-to-face arranged end portions sealed together adjacent a longitudinal packing edge to form a fin seal; said end portions forming, beyond the fin seal, two longitudinal panels; the wrapper sheet further having two opposite end closure flaps folded, from opposite longitudinal ends of the product, onto the sleeve on one of the large faces, and said panels being folded onto the sleeve on said one large face; one of said panels being an inner panel and the other panel being an outer panel; the inner panel being closer to the product then the outer panel; the improvement wherein said outer panel projects beyond said inner panel and covers said end closure flaps; further comprising securing means to attach said outer panel to said sleeve on said one large face.

2. A packing as defined in claim 1, wherein said longitudinal packing edge is a first longitudinal packing edge; said packing having a second longitudinal packing edge extending parallel to said first longitudinal packing edge and being spaced therefrom by said width; said outer panel having a longitudinal terminal edge substantially coinciding with said second longitudinal packing edge.

3. A packing as defined in claim 1, wherein wrapper sheet portions forming each said end closure flap are bonded together by a sealing seam.

4. A packing as defined in claim 1, further comprising a tear-open strip contained in the wrapper sheet and extending across said packing generally in a direction of said width; and tearing slots provided in a terminal longitudinal edge of said outer panel adjacent to, and on both sides of, said tear-open strip.

5. A packing as defined in claim 4, wherein an angle formed between said tear-open strip and said longitudinal packing edge is other than 90°.

6. A packing as defined in claim 1, wherein said securing means comprises areas of adhesive; further comprising additional areas of adhesive bonding said outer panel to said end closure flaps.

7. A packing as defined in claim 1, wherein said outer panel projects beyond said inner panel along an entire length dimension thereof; further wherein said inner panel has a longitudinal folding edge extending along and in the immediate vicinity of said longitudinal packing edge; each said end closure flap having a folding edge extending along said width and a terminal folding edge; said inner and outer panels having a flap-forming folding edge extending along said width; said longitudinal folding edge of said outer panel, and respective said flap-forming folding edges and respective said terminal folding edges of said end closure flaps extending from a common packing corner.

8. A method of packaging a flat, rectangular product having parallel long sides, parallel short sides and opposite large faces; comprising the following steps:

(a) wrapping a wrapper sheet about the product;

(b) forming a longitudinal fin seal adjacent a long side by sealing together superposed wrapper sheet portions; said portions constitute, beyond said fin seal, superposed longitudinal inner and outer panels; said outer panel projecting beyond a longitudinal outer terminal edge of said inner panel;

(c) folding said superposed panels as a unit into an oblique orientation with respect to said large faces;

(d) partially folding-in and subsequently sealing end closure flaps constituting portions of the wrapper sheet projecting beyond opposite length boundaries of the product;

(e) providing said outer panel with an adhesive;

(f) folding and pressing said end closure flaps flat onto one of said large faces; and (g) folding and pressing said inner and outer panels flat onto said one large face.

9. A method as defined in claim 8, further comprising the steps of applying, prior to step (a), a tear-open strip across the wrapper sheet at an angle other than 90° to parallel longitudinal edges of the wrapper sheet and providing cuts at least along one longitudinal edge of the wrapper sheet, on either side of the tear-open strip.

* * * * *